US007340997B2

(12) United States Patent
Haider

(10) Patent No.: US 7,340,997 B2
(45) Date of Patent: Mar. 11, 2008

(54) PRESS COMPRISING A CORRECTION OF A PRESS BAND COURSE

(75) Inventor: Erich Haider, Gilgen (AT)

(73) Assignee: Kronospan Technical Co., Limited, Engomi, Nicosia (CY)

( * ) Notice: Subject to any disclaimer, the term of this patent is extended or adjusted under 35 U.S.C. 154(b) by 0 days.

(21) Appl. No.: 10/553,456

(22) PCT Filed: May 16, 2003

(86) PCT No.: PCT/EP03/05140

§ 371 (c)(1),
(2), (4) Date: Oct. 17, 2005

(87) PCT Pub. No.: WO2004/096531

PCT Pub. Date: Nov. 11, 2004

(65) Prior Publication Data

US 2006/0246168 A1 Nov. 2, 2006

(30) Foreign Application Priority Data

May 2, 2003 (DE) ..... 203 06 758 U

(51) Int. Cl.
*B30B 5/06* (2006.01)

(52) U.S. Cl. ..... 100/151; 100/41; 100/47

(58) Field of Classification Search ..... 100/118, 100/151, 152, 153, 154, 168, 306, 307, 43, 100/47, 48; 156/583.3, 583.5; 425/371, 425/372, 373

See application file for complete search history.

(56) References Cited

U.S. PATENT DOCUMENTS

| | | | | |
|---|---|---|---|---|
| 3,723,230 | A * | 3/1973 | Troutner | 156/580 |
| 3,942,927 | A | 3/1976 | DeMets | |
| 4,015,921 | A * | 4/1977 | De Mets | 425/371 |
| 4,043,733 | A | 8/1977 | DeMets | |
| 4,629,061 | A | 12/1986 | Crandall | |
| 5,492,215 | A * | 2/1996 | Affeldt et al. | 198/464.4 |
| 2003/0213380 | A1 * | 11/2003 | Sebastian et al. | 100/151 |

FOREIGN PATENT DOCUMENTS

| | | |
|---|---|---|
| DE | 4110678 | 10/1992 |
| DE | 19828823 | 8/1999 |
| DE | 19824723 | 4/2000 |
| DE | 19931175 | 1/2001 |

* cited by examiner

*Primary Examiner*—Jimmy T. Nguyen
(74) *Attorney, Agent, or Firm*—Pearne & Gordon LLP

(57) ABSTRACT

A press for pressing a material to form a structural component comprises at least one revolving press band and a control for controlling the course of the press band. The control is preferably carried out via rotating rods that engage the press band and that can be tilted at a convenient angle for the purposes of varying the direction of travel of the press band. According to the method, the band of the press can be controlled by appropriately tilting the rotating rods.

2 Claims, 3 Drawing Sheets

PRESS COMPRISING A CORRECTION OF A PRESS BAND COURSE

BACKGROUND OF THE INVENTION

The invention relates to a continuous, and in particular, double-belt, press as well as to a method for controlling the course of the pressing belt. The double-belt press comprises two revolving belts that are urged against each other. DE 41 10 678 C1 as well as DE 198 24 723 C1 disclose presses of the type according to the invention.

The continuous press is used to compress wood particles, fibers, chips provided with adhesives or an already pre-compressed fiber mat, in particular while heat is supplied.

There is the problem, particularly in a double-belt press, that a revolving belt runs out to the left or the right seen in the direction of transport. The problem of the belt running out is especially problematic in the pressing area. In a double-belt press, this area is located between the two rollers at the front and rear end around which the respective steel-belt is guided.

In the pressing area, there are rotating rods or rollers that suitably exert pressure on the respective pressing belt in the direction of the material to be compressed. In particular, several rotating rods are arranged parallel to each other and are attached to a chain, on the right hand side and the left hand side. The two chains are driven by means of gear-wheels. The gearwheels are mounted laterally on an input shaft and an output shaft, respectively. In this manner, the rotating rods, together with the chains, also form a revolving belt. Therefore, the rotating rods or the belt formed by them on one side abut a pressing belt.

The above mentioned features belong to the present invention individually or in combination.

DE 41 10 678 C1 discloses a feed-through press comprising steel belts that are driven in a revolving manner. In the pressing area, the respective steel belt is guided as such by means of rotating bodies or rotating rods. The course of the respective steel belt is corrected by varying the pressure the rotating rods exert on the pressing belt.

The course of a steel belt employed as a press belt may in principle be controlled successfully through the change in the pressure that the rotating rods exert on the pressing belt. In the aforementioned solution of the problem, the pressure acting on the material to be compressed is disadvantageously also varied. This results in negative effects on the quality of the product.

This present problem occurs especially in particularly long presses. Here, a revolving pressing belt tends especially strongly to deviate from the desired course in the pressing area.

A method for adjusting the infeed contour of the infeed mouth of a continuous press can be gathered from DE 198 247 23 C1. According to this, the upper infeed plate of the infeed mouth is deformed by means of differential cylinders while forming an infeed contour with at least a mat contact zone on the side of the infeed, a mat clamping zone adjacent to the mat contact zone and a mat joining zone adjacent to the mat clamping zone. In this manner, both material jam occurring during the compaction of the material as well as blowing out, even at high press speeds, are avoided.

BRIEF SUMMARY OF THE INVENTION

The object of the invention consists in providing a method as well as an apparatus in which, on the one hand, the pressing belt of a continuous press maintains the desired course in an improved manner and, on the other hand, the quality of the product is not affected negatively as occurred in prior art control techniques.

According to the invention, it is especially avoided to change the pressure of the rotating rods with which the rotating rods press on the pressing belt. Instead, the rotating rods are only aligned with regard to their position within the plane that is parallel to the pressing belt. In the normal state, the rotating rods are ideally aligned perpendicularly to the direction of travel of the pressing belt. If a pressing belt deviates from the desired course in an undesired manner, the rotating rods, relative to the pressing belt, are turned out of this perpendicular position in such a way that a counter-effect is achieved and the pressing belt reverts to the desired course. In this way, it is achieved that the pressing belt is guided back into the desired position or that it takes the desired course. It is not required to change the pressure that the rotating rods exert on the pressing belt. A constant quality of the product is achieved in this manner.

An apparatus for executing the method in an advantageous embodiment comprises measuring devices for registering the course of the pressing belt within the pressing area. The apparatus further comprises a control device or control means for controlling, dependent upon the measured course of the belt, the position of the rotating rods suitably in the aforementioned manner.

A mechanical probe, in particular, is employed as a probe for checking the course of the belt. In a particularly simple embodiment, this comprises an end with a roller adjacent to the belt. The probe is shifted mechanically as soon as the belt changes its position. The mechanical change is registered and input into the control device. The position of the gearwheels over which the chains are guided is changed suitably by means of the control device. The control is typically effected via a power cylinder with a maximum lift of preferably at least ±1 mm. As a rule, however, control for suitably correcting the course of the belt is effected within a range of tenths of millimeters. Basically, a smaller lift of more than 1/10 of a millimeter may therefore already be sufficient.

As has already been described, the rotating rods are preferably located to the left and right of a chain or rather, are attached to two chains. The chains are driven via gearwheels. There are gearwheels that are responsible for the rotating rods abutting the respective belt. Further gear-wheels are provided in another plane. These gearwheels inter alia serve the purpose of tightening the chain.

Due to the production process or because of material fatigue, the chain links, undesirably, have different lengths. Therefore, it may happen in a chain that individual chain links, for example, have been stretched undesirably during operation. Such an undesired stretch leads to the conveyor belt running out towards the left or towards the right of the desired course in the above mentioned manner. Chain links of different lengths therefore lead to disturbances in production.

The position of the input shaft determines the position of the rotating rods in the area of the infeed. Therefore, it is thus ensured that the rotating rods are located perpendicularly to the pressing belt and that thus, a pressing belt is at first controlled correctly. In the middle area, in particular, the aforementioned perpendicular position of the rotating rods that is desired as such may change, for example, due to stretched chain links. This undesired deviation from the perpendicular position occurs particularly strongly when no compression takes place. Due to stretched chain links, therefore, rotating rods may be positioned "diagonally" in the middle area. This means that the rotating rods or the rotating bodies are not aligned perpendicularly relative to the conveying direction in which the pressing belt conveys.

The material to be pressed is fed into the press at many times the speed, typically at twice the speed compared with the conveying speed of the rotating rods. This may cause the material to be pressed to arrive in an area of the press where the rotating rods run diagonally in the aforementioned sense. At that moment, the undesired diagonal position would cause the press belt to deviate from the desired intended course. The aforementioned problem only occurs in the case of the start of a pressing cycle.

At the beginning of a pressing process or press cycle, attention must be paid that it starts when no running out of the belt due to diagonally positioned rotating rods, for example because of different lengths of links of a chain, is to be expected.

DETAILED DESCRIPTION OF THE INVENTION

Figure 1:
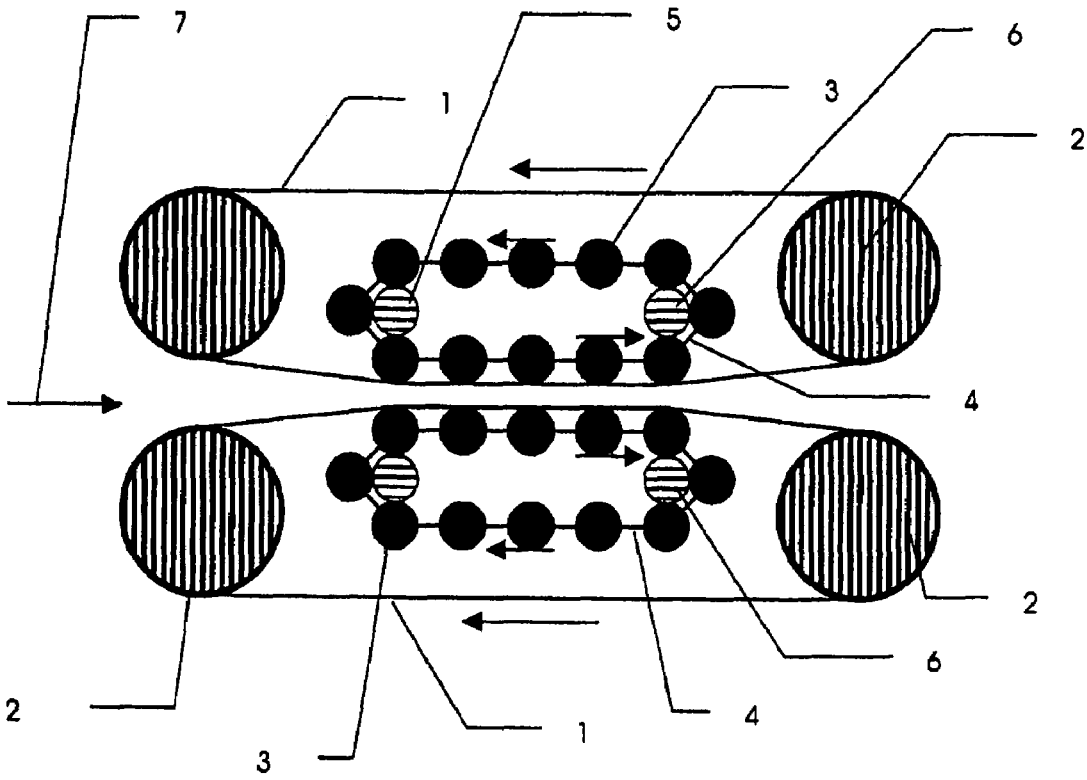
FIG. 1 is a schematic elevational view of a continuous press having adjacent pressing belts for pressing a board product and further including rotating rod assemblies for guiding the course of the belts in accordance with the invention.

According to the invention, it is now being determined to what extent a diagonal course or a diagonal position of rotating rods is to be expected, for example due to undesirably stretched chain links. These interferences are taken into account in controlling. Therefore, it is determined prior to starting when and where a diagonal position is to be expected, for example due to undesirably stretched chain links. Depending on this, the position of the input shaft(s) with the gearwheels located thereon, via which the aforementioned chains run, is controlled. It is possible in this manner to start a press cycle at any point in time, This leads to an acceleration of the start of the pressing compared to the state of the art.

Stretched chain links can be detected indirectly or directly.

They may, for example, be detected indirectly by empirically establishing the course the pressing belt takes. Based on the course of the belt, a statement on stretched chain links may then be made or it may directly be empirically determined how the input shaft is to be aligned in order to avoid disturbances due to different lengths of chain links, The length of chain links may of course be also measured directly. However, this takes a lot of effort since the measurement must take place in an idle state. It is a matter of differences in the range of tenths of millimeters. Ranges of hundredths of millimeters also play a role. A chain may easily be 100 m long. The effort as regards measurement technique is thus very large for determining the length of each link of the chain by measuring. Therefore, as a rule, this procedure is not carried out. However, direct measurement is also possible in principle.

Another measuring method is to provide at the input shafts or the gearwheels a visual marking or a pulse generator emitting, for example, electric pulses. If both chains have equally long chain links, there is no diverging of the pulse generators or markings in relation to each other. Always at the same point in time, these transmit a pulse to one sensor each, or, two sensors measure the markings at the same point in time. If there are differences between the chains due to different chain lengths, the sensors register the pulses or markings at different times. From this, differences of the links of the chain can be detected, for example calculated. This may be taken as an input value to effect the control according to the invention. Through the control, chain flaws, i.e. different lengths in the chain links, are compensated. The production can be accelerated and/or the product quality improved over the state of the art.

In a further embodiment of the invention, gearwheels are employed advantageously that serve the sole purpose of measuring or taking measurements of the chain. These additional gearwheels have pulse generators or visual markings. The gearwheels are, in particular, inserted in pairs behind each other. These have a very small distance in relation to each other of, e.g., 1000 mm, The times of the pulse generators are compared with each other. Resulting deviations yield information on resulting deviations of the intended chain length or the chain link length. In addition, the diagonal positioning of the rotating rods in the pressing area is directly determined by this. Thus, a total of four gearwheels is employed. Preferably, they are located in the return area in order not to have any influence whatsoever upon the production process as such. For in the pressing or production area, the acquired information may be faulty because the influences of pressure may distort the result.

A pair of gearwheels positioned opposite to each other and having pulse generators or visual markings serve, in particular, the purpose of determining precisely the position of a rotating rod. Gearwheels that are arranged behind each other in the direction of movement preferably serve the purpose of the exact determination of lengths of the chain links.

Thus, the invention is able to solve two problems:

1. A problem occurring during the production process, i.e. during pressing, which were mentioned at the beginning in the state of the art, can be solved.
2. A second problem occurring during the start-up of a pressing apparatus is solved in an embodiment of the invention.

The invention is especially employed in the production of laminate floorings. A laminate flooring comprises a board, preferably of a derived timber product such as, e.g. HDF, MDF or a chip board. Papers are applied on top and on the bottom of such a core material. On the one side, a decorative paper is provided which determines the appearance of the floor. On the other side, a backing paper is provided which prevents warping of the board after the pressing. Above the decorative paper is an abrasion resistant layer for protecting the floor against abrasion. Underneath, an additional layer of sound-absorbing material may be provided.

According to the invention, lateral areas of the pressing belt are slowed down or accelerated suitably in order to control the course of the pressing belt in this way.

EXEMPLARY EMBODIMENT

FIG. 1 outlines a continuous press for the production of MDF, HDF or chip boards or the like. Two pressing belts 1 consisting of steel are guided around the rollers 2. Pivoted rods 3 that are called rotating rods are connected with each other via chains 4 in a belt-like manner. The chains are driven by gearwheels that are not shown, The gearwheels are located at the ends of input shafts 5 and output shafts 6. The belt formed of the rotating rods 3 is guided around the aforementioned shafts 5 and 6 with a significantly lower speed, as a rule, than the speed with which the pressing belts 1 are guided around the rollers 2. The result is that the pivoted rotating rods turn.

The material to be pressed is transported into the press along the arrow 7. Pressing then takes place in the area against which the rotating rods abut.

Figure 2:
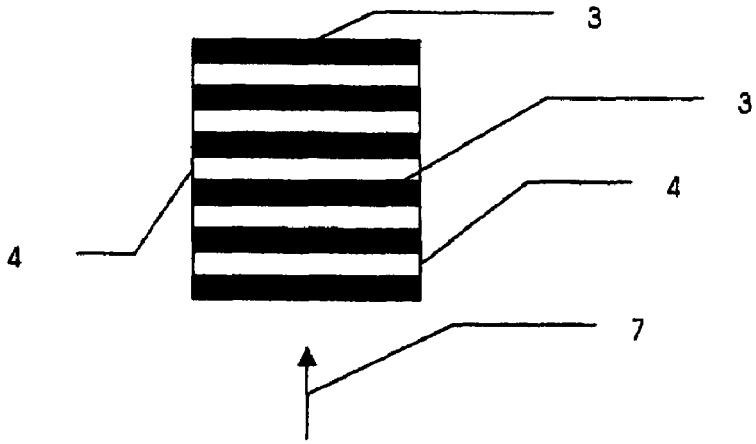
FIG. 2 is a schematic plan view of one of the rotating rod assemblies shown in FIG. 1.

FIG. 2 shows a top view onto the rotating rods 3. These are arranged perpendicularly to the direction of transport 7.

Figure 3:
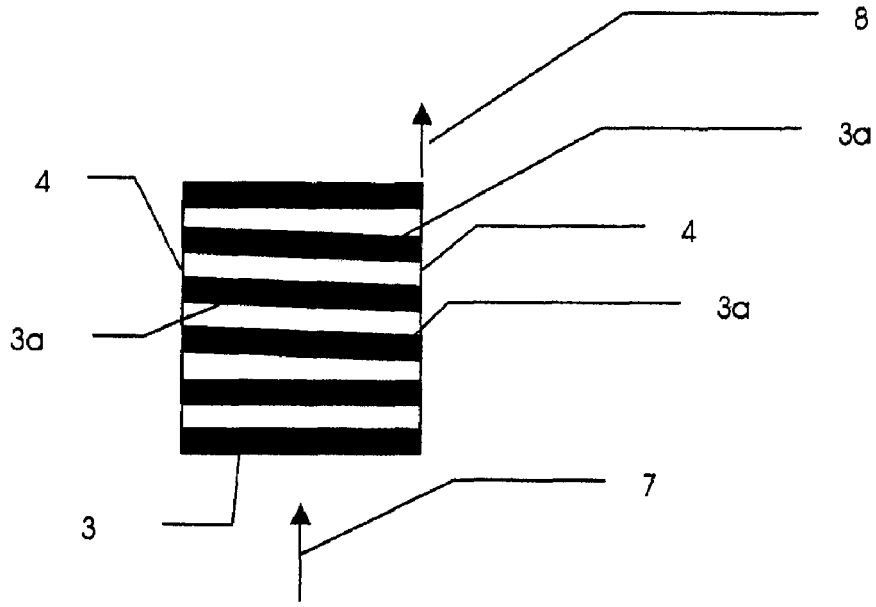
FIG. 3 is a schematic plan view similar to FIG. 2, but having several tilted or slightly diagonal rods in the rod assembly.
Figure 4:
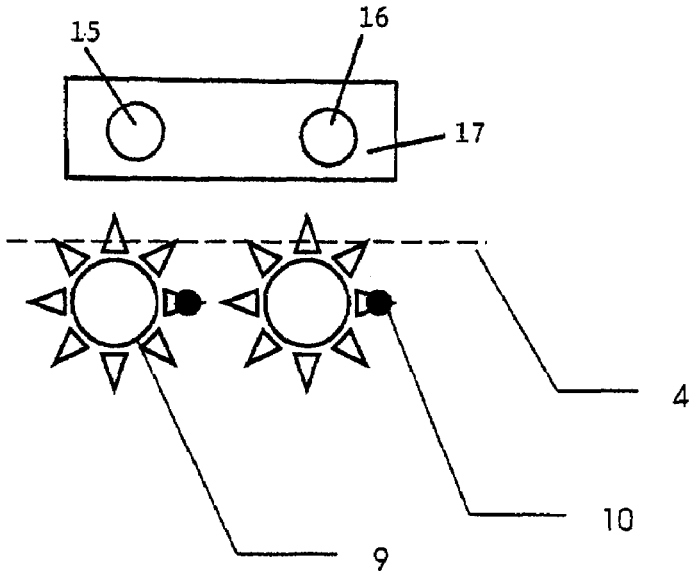
FIG. 4 is a schematic elevational view of the gearwheels for guiding chains carrying the rods, including pulse generators in accordance with the invention.

In FIG. 3, the case where a group of rotating rods 3*a* is not aligned exactly perpendicularly relative to the direction of transport 7 due to chain links of the chains 4 having different lengths is being shown in a top view. This diagonal position effects an undesired deviation of the pressing belt from the desired course when this diagonally aligned rotating rod presses on the pressing belt in order to transmit pressure onto the material to be pressed.

According to the invention, this deviation is counteracted by, for example, temporarily aligning the output shaft not shown in FIG. 3 in the opposite diagonal direction, i.e., according to FIG. 3, shifting it on the right side in the direction of the arrow 8 in order to thus compensate the slant of the rotating rod 3*a*.

This compensation serves the purpose of being able to start up a press cycle without having to pay attention to influences by chain links of different lengths. Independently, input and output shafts or other suitable shafts and the like are continuously aligned, depending on the course of the pressing belt, in such a way that the desired course of the pressing belt is maintained in an improved way.

In one embodiment, for example, two gearwheels 9 are arranged behind each other and provided with markings or pulse generators 10, in order to determine differences in the chain links of a chain 4. Sensors 15 and 16 register the markings, for example, in the "three o'clock" position shown. As long as the two markings 10 are registered at the same time by the sensors, as determined by evaluation device 17, there are no chain links of different lengths. Only if a chain link comes between the two gearwheels that is stretched as compared to the others will the markings be registered at different points in time. By means of the speed of rotation of the gearwheels and the difference in time, the deviation regarding the length of the chain link can be determined. This information is utilized in controlling the alignment of the rotating rods.

Figure 5:
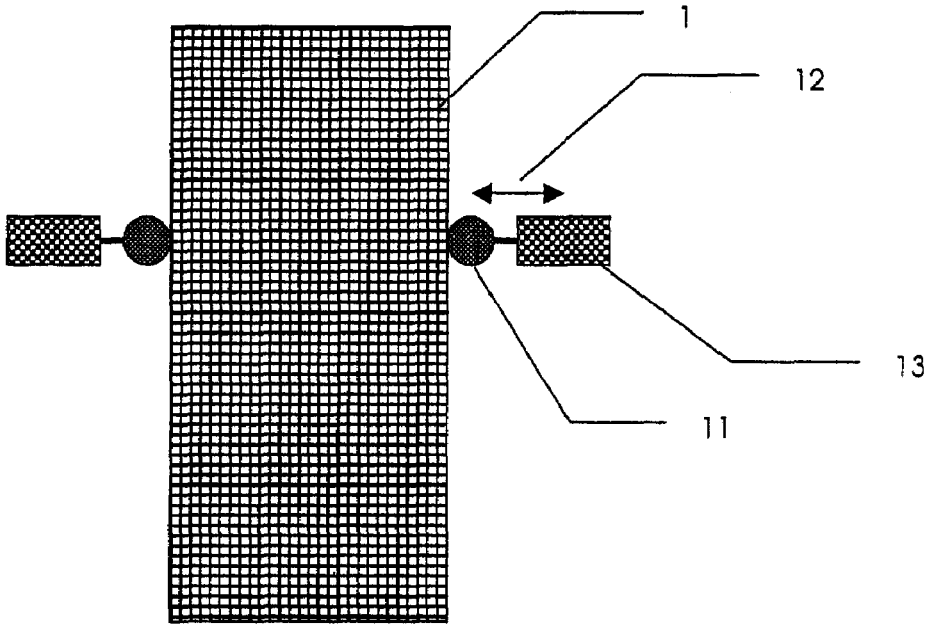
FIG. 5 is a schematic plan view of one of the pressing belts shown in FIG. 1 and further including a mechanical probe for monitoring the course of the pressing belt in accordance with the invention.

By means of FIG. 5, it is illustrated in a top view how the course of the pressing belt or deviations from the desired course can be determined. Pivoted little wheels 11 are urged by means of spring force towards the respective edge of the pressing belt. They can also be shifted along the double arrow 12. A displacement gauge 13 is capable of acquiring this movement along the double arrow 12.

If the pressing belt 1 deviates from the desired course, the little wheels 11 move correspondingly along the double arrow 12. The respective displacement gauge 13 acquires the change. The change directly represents the deviation from the desired course.

The acquired change is transmitted to an electronic system. In response, this now controls the diagonal positioning of corresponding rotating rods until the desired course is restored.

The invention claimed is:

1. Press for pressing a material to be pressed into a component, said press having at least one revolving pressing belt movable along a course in a transport direction through a pressing area and control means for controlling the course of the pressing belt, the control means comprising rotating rods engaging the pressing belt and also including positioning means for positioning the rotating rods diagonally relative to the direction of transport of the pressing belt, the rotating rods being laterally attached to revolving chains to drivingly engage and drive lateral areas of the pressing belt to control the course of the pressing belt, the chains including chain links, gearwheels engaging the revolving chains to which the rotating rods are laterally attached, the gearwheels being provided with markings or pulse generators to provide a gearwheel signal, sensors together with an evaluation device arranged to receive the gearwheel signal so that stretched chain links of the revolving chains can be detected, and the control means controlling the position of the rotating rods dependent on the length of individual chain links of the chain.

2. Method for controlling a pressing belt in a press having at least one revolving pressing belt movable along rotating rods engaging the pressing belt diagonally relative to a direction of transport of the pressing belt in a pressing area, the rotating rods being laterally attached to revolving chains including chain links, comprising the steps of:

drivingly engaging lateral areas of the pressing belt with the rotating rods, providing gearwheels engaging the revolving chains to which the rotating rods are laterally attached, providing the gearwheels with markings or pulse generators to provide gearwheel signals, providing sensors for sensing the gearwheel signals and an evaluation device for evaluating the sensed gearwheel signals, sensing the gearwheel signals with the sensors and evaluating the sensed signals to detect stretched chain links of the revolving chains, and controlling the position of the rotating rods dependent on the detected length of individual chain links of the chain and the course of the pressing belt in the pressing area by laterally slowing down or accelerating the pressing belt.

* * * * *